US007257936B2

(12) United States Patent
Salicini et al.

(10) Patent No.: US 7,257,936 B2
(45) Date of Patent: Aug. 21, 2007

(54) METHOD AND DEVICE FOR WRAPPING GROUPS OF STACKED PRODUCTS IN THE MANUFACTURE OF SEALED PACKS

(75) Inventors: Sandro Salicini, Monterenzio (IT); Stefano Cavallari, Bologna (IT)

(73) Assignee: Azionaria Costruzioni Macchine Automatiche A.C.M.A. S.p.A., Bologna (IT)

( * ) Notice: Subject to any disclaimer, the term of this patent is extended or adjusted under 35 U.S.C. 154(b) by 15 days.

(21) Appl. No.: 10/546,650

(22) PCT Filed: Feb. 23, 2004

(86) PCT No.: PCT/IB2004/000576

§ 371 (c)(1),
(2), (4) Date: Aug. 24, 2005

(87) PCT Pub. No.: WO2004/076285

PCT Pub. Date: Sep. 10, 2004

(65) Prior Publication Data

US 2006/0185328 A1 Aug. 24, 2006

(30) Foreign Application Priority Data

Feb. 25, 2003 (IT) ..... BO2003A0093

(51) Int. Cl.
*B65B 7/08* (2006.01)
*B65B 11/32* (2006.01)

(52) U.S. Cl. ..... 53/482; 53/212; 53/226; 53/466

(58) Field of Classification Search ..... 53/463, 53/466, 211, 222, 223, 224, 225, 226, 387.1, 53/387.2, 481, 482, 234
See application file for complete search history.

(56) References Cited

U.S. PATENT DOCUMENTS

| | | | | |
|---|---|---|---|---|
| 2,196,666 | A * | 4/1940 | Moore | 53/456 |
| 2,620,964 | A * | 12/1952 | Rose et al. | 229/87.18 |
| 3,110,144 | A * | 11/1963 | Johansen et al. | 53/224 |
| 3,812,644 | A * | 5/1974 | Kamikawa et al. | 53/459 |
| 4,617,782 | A * | 10/1986 | Mattei et al. | 53/479 |
| 5,802,819 | A * | 9/1998 | Boldrini | 53/480 |
| 6,502,370 | B2 * | 1/2003 | Martelli | 53/449 |
| 6,643,997 | B1 * | 11/2003 | Schwenke et al. | 53/482 |
| 6,901,725 | B2 * | 6/2005 | Salicini et al. | 53/466 |

FOREIGN PATENT DOCUMENTS

| | | |
|---|---|---|
| GB | 1 532 654 | 11/1978 |

* cited by examiner

*Primary Examiner*—Sameh H. Tawfik
*Assistant Examiner*—Paul Durand
(74) *Attorney, Agent, or Firm*—Timothy J. Klima

(57) ABSTRACT

Groups of products stacked on edge are wrapped in sealed stick packs by a method that involves passing a sheet (4) of heat-sealable wrapping material around each group (1) of products (2) and sealing the two side edges (8) in such a way as to fashion a tubular wrapper (12) with end portions (14) projecting axially from the assembled group (1), then spreading each end portion (14) flat by inserting a tongue (16) and heat-sealing each relative pair of flattened edges to render the wrapper airtight. Thereafter, the sealed ends are subjected to a cold crimping action from which each end portion (14) emerges with two impressed crease lines (24) positioned to delimit a central portion (25) that will be folded directly against the corresponding end face of the group (1), and two lateral portions (26) that will be folded inwards over the central portion (25).

8 Claims, 5 Drawing Sheets

METHOD AND DEVICE FOR WRAPPING GROUPS OF STACKED PRODUCTS IN THE MANUFACTURE OF SEALED PACKS

This application is the National Phase of International Application PCT/IB2004/000576 filed Feb. 23, 2004 which designated the U.S. and that International Application was published under PCT Article 21(2) in English.

This application claims priority to Italian Patent application number BO2003A 000093, filed Feb. 25, 2005, which is incorporated by reference herein.

TECHNICAL FIELD

The present invention relates to a method and a device for wrapping groups of stacked products in the manufacture of sealed packs.

In particular, the present invention relates to a method and a device finding useful application in the confectionery or pharmaceutical industry for making stick packs of sweets or pastilles.

BACKGROUND ART

As a rule, products wrapped in stick packs for general retail are of typically flat parallelepiped shape and ordered into a wrappable group one beside the next, with the larger faces disposed transversely to the predominating axis of the assembled group. Accordingly, the group of products will present at least one relatively small transverse dimension, and the stick pack is fashioned using simple heat seal jaws by which the projecting edges of a tubular wrapper formed around the group can be gripped and secured tight against the ends of the group without generating random creases or other imperfections that might in time allow air into the finished pack.

The above considerations do not apply to another type of stick pack on general sale, in which the products are again ordered one beside the next with the larger faces in mutual contact, though in this instance forming a much more compact group generally of square or rectangular section. The ends of this type of stick are ordinarily not sealed, but simply folded. In the event of a sealed end being required for this second type of stick pack, the seal is obtained starting from a tubular wrapper of which the trimmable ends project an appreciable distance beyond the end faces of the group of products. By virtue of this extra length, the opposite edges presented by each end of the wrapper can be pinched together. Sticks presenting this type of seal are however not readily acceptable in terms of appearance, difficult to stack, unable to retain the wrapped products in close contact one with another, and inclined to break or tear open easily at the ends.

The prior art also embraces a method for forming packets of the type described above, disclosed in patent DE 3420023 by the same applicant, which envisages the step of fashioning a tubular wrapper initially around the group of stacked products and then closing the ends of the wrapper. The process of closing each end includes a first step in which the ends are drawn flat, by inserting flat spreader means, and united by the action of sealing and crimping means designed to impress crease lines on each of the flattened ends so as to facilitate a subsequent folding step. In practice, the final step occurs with the sealed and crimped end already presenting a central portion, and two lateral portions delimited on either side of the central portion by the crease lines. The central portion is folded against the end face of the group of products and the lateral portions are then folded over the central portion.

The method described above likewise presents certain drawbacks connected principally with the step in which the sealing and crimping operations occur. In effect, a dependable closure of the ends cannot be assured when the sealing and crimping steps are combined, since the sealing jaws are not able to unite the edges of the wrapper faultlessly along the crease lines.

The object of the present invention is to set forth a method and a device free of the drawbacks mentioned above, by means of which products stacked on edge and in contact one with the next by way of their larger faces can be packaged in a sealed wrapping.

DISCLOSURE OF THE INVENTION

The stated object is realized by adopting a method and a device for wrapping groups of stacked products in the manufacture of sealed packs, as recited in one or more of the claims appended.

The invention will now be described in detail, by way of example, with the aid of the accompanying drawings, in which.

Figure 1:
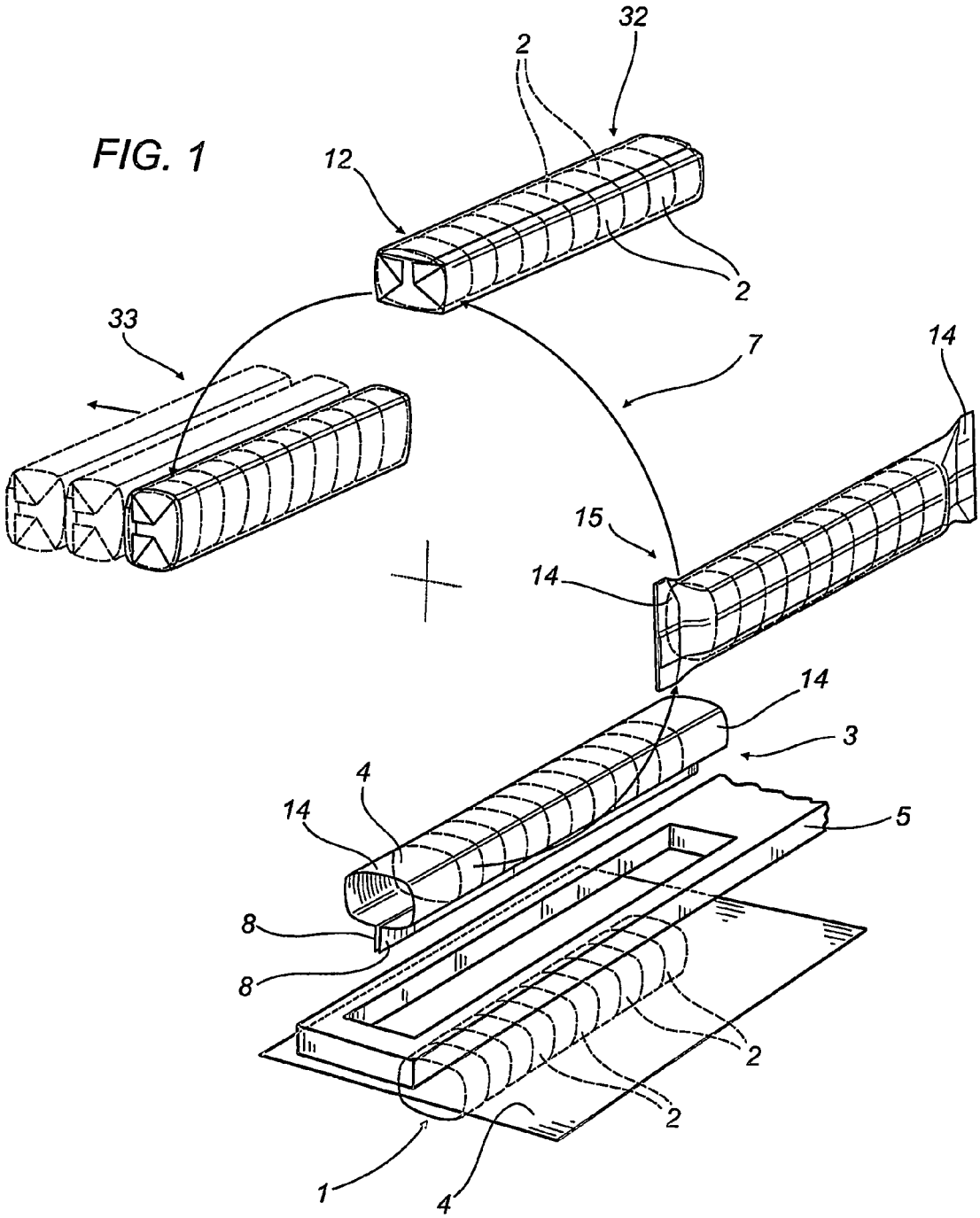
FIG. 1 illustrates a wrapping line of a sweet packaging machine embodied according to the present invention, viewed schematically and in perspective.

FIG. 1 of the drawings illustrates a wrapping line of a machine (not illustrated) for packaging groups 1 of products 2, in particular items of confectionery such as sweets presenting a flat parallelepiped shape, stacked on edge with the larger flat faces offered one to the next.

At the start of the wrapping line, the assembled group 1 is directed into a first wrapping station 3 where a sheet 4 of heat-sealable wrapping material is positioned over the selfsame group 1 by feed means not illustrated in the drawings.

Figure 2:
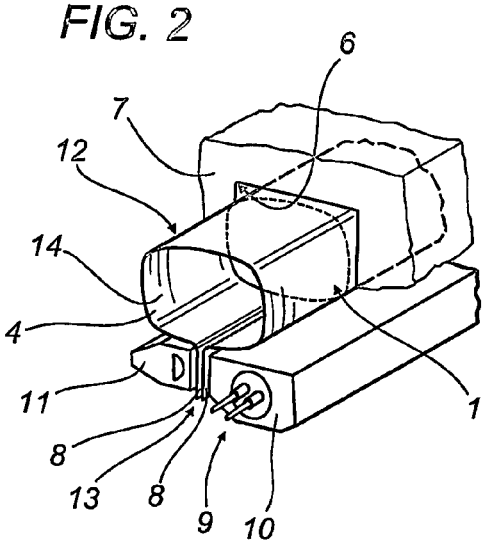
FIG. 2 illustrates a first detail of the device according to the present invention, shown in a first operating step.

From this position, the group 1 is directed by the action of pusher means (not illustrated) against the wrapping sheet 4 and through a folding shoe 5, with the result that the sheet 4 will be bent over the lateral faces of the group 1 to assume a "U" profile. As indicated in FIG. 2, the group 1 is inserted together with the sheet 4 into a conveying pocket 6 afforded by the periphery of a wrapping wheel 7, extending parallel to a straight line generator of the wheel 7. In effect, the wheel 7 is furnished with a plurality of such pockets 6 each serving to accommodate one group 1 enveloped by a respective sheet 4. The wheel is also rotatable in such a way as to direct each group 1 of products 2 through a series of wrapping stations.

As discernible in FIG. 2, the wrapping sheet 4 is disposed with two opposite side edges 8 projecting radially from the relative pocket 6, and these same edges are directed into contact one with another by a heat-sealer 9 of which one jaw consists in a heat seal element 10 and the other a reaction element 11. The heat-sealer 9 serves to form a tubular wrapper 12 presenting a heat-sealed fin 13 along one side, formed by joining the two edges 8, and two tubular extremities or end portions 14 projecting beyond the opposite ends both of the group 1 of products and of the relative pocket 6.

Figure 3:
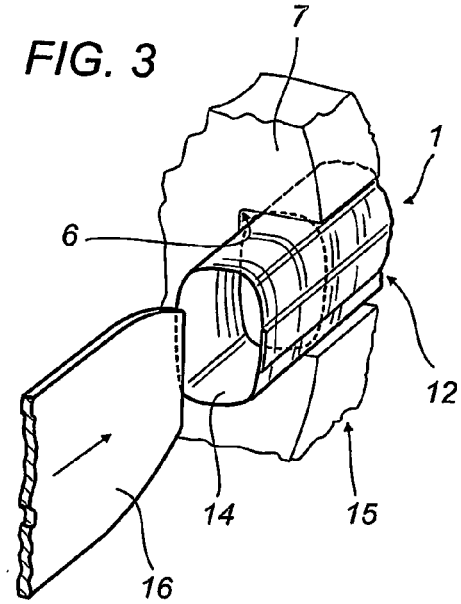
FIGS. 3 and 4 show a second detail of the device disclosed, illustrated in respective subsidiary steps of a second operating step.
Figure 4:
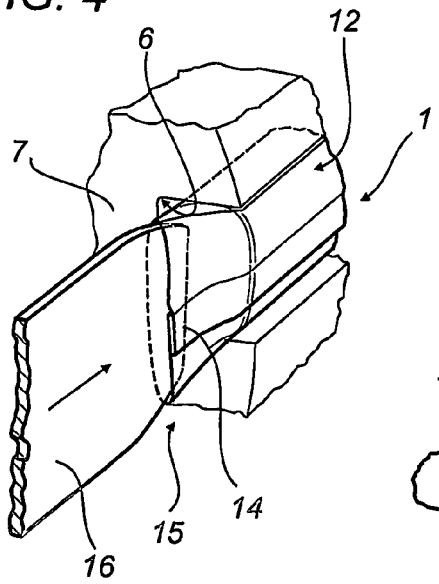

The group 1 and the relative tubular wrapper 12 are directed by the wheel 7 as it indexes through a step of predetermined angular distance, for example 90°, to a second wrapping station 15 where a tongue 16 is introduced into each of the two end portions 14, as indicated in FIGS. 3 and 4. The tongue is tapered toward the free end and insertable thus gradually into the relative end portion 14 in such a manner as to spread and flatten the tubular extremity progressively, causing it to assume a position substantially tangential to the periphery of the wheel 7 and stretching the material slightly so as to induce a measure of plastic deformation that will render the flattened configuration permanent.

Figure 5:
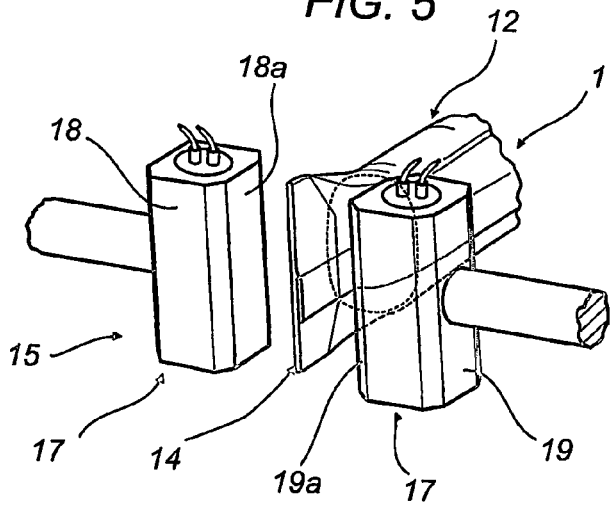
FIG. 5 illustrates a third detail of the device disclosed in a third operating step.

Thereafter, and still at the second station 15, the tongues 16 are withdrawn and the end portions 14 pinched and fastened together, as illustrated in FIG. 5, by the action of respective heat-sealers 17 operating on the selfsame portions 14.

Each of the heat-sealers 17 in question comprises two heat seal elements 18 and 19 presenting relative flat heated surfaces 18*a* and 19*a* capable of movement toward and away from one another. Following the action of the heat-sealers 17, each end portion 14 remains permanently sealed, presenting a flat seam.

Figure 6:
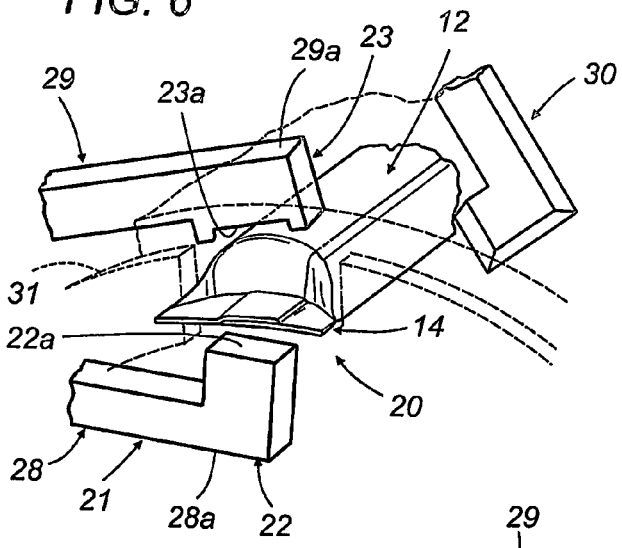
FIGS. 6 and 7 show a fourth detail of the device disclosed, illustrated in respective subsidiary steps of a fourth operating step.

With reference to FIGS. 6 . . . 12, the group 1 and the relative wrapper 12 are directed by the wrapping wheel 7, indexing through a further angle preferably of 90°, to a third wrapping station 20 that consists in a folding unit 21 by which each of the flattened end portions 14 is crimped and folded against the respective end face of the group 1.

The folding unit 21 comprises a first folder element 22 and a second folder element 23 presenting respective contact ends 22*a* and 23*a* capable of movement between a position distanced one from the other, and a position of mutual proximity in which the relative flattened end portion 14 of the wrapper is gripped between them and crimped to generate crease lines 24 dividing the end portion 14 into a central portion 25 and two lateral portions 26. The two crease lines 24 are thus formed by a cold crimping step following the heat-seal closure of the ends and, in the preferred embodiment of the drawings, will extend substantially parallel to the longitudinal axis of the tubular wrapper 12.

Figure 9:
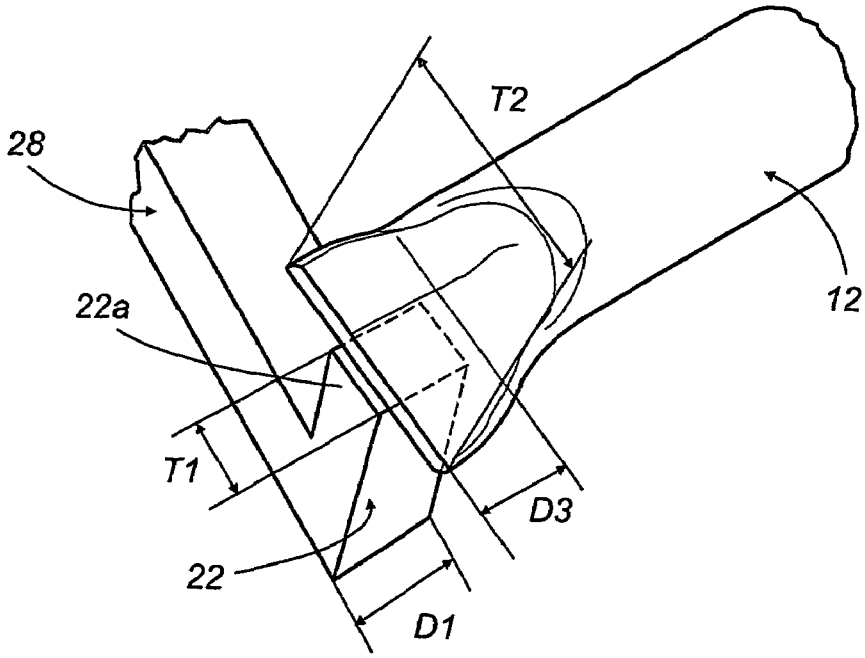
FIG. 9 shows the subsidiary step of FIG. 6 from a different standpoint and with certain parts omitted better to reveal others.
Figure 10:
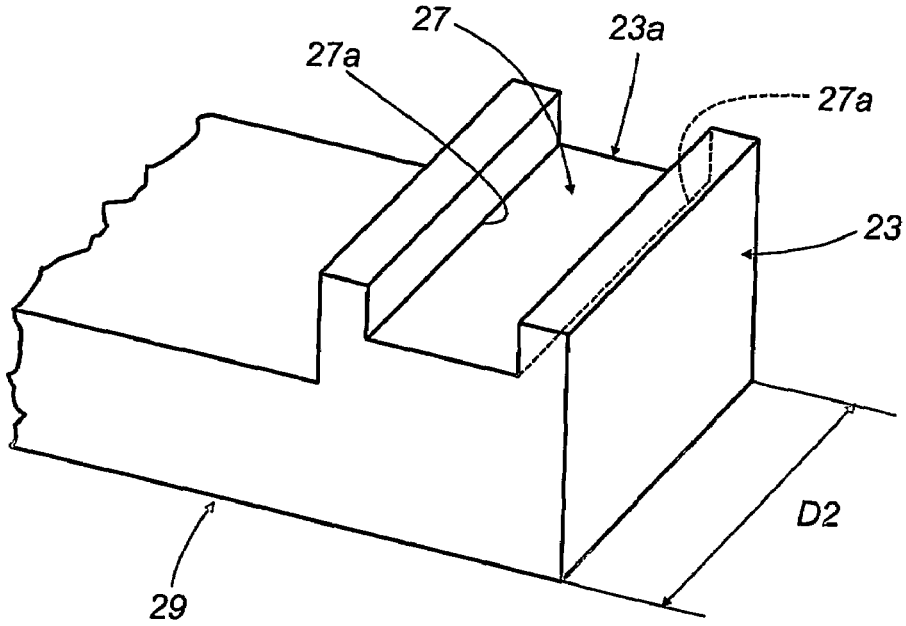
FIG. 10 shows a portion of the fourth detail as in FIGS. 6 and 7, from beneath and in perspective.

More exactly, the contact end 22*a* of the first folder element 22 is of parallelepiped geometry and presents a dimension T1, measured transversely to the axis of the tubular wrapper 12, smaller than the corresponding transverse dimension T2 of the sealed end portion 14 (FIG. 9). To advantage, moreover, the contact end 23*a* of the second folder element 23 presents a U profile creating a recess 27 designed to accommodate the contact end 22*a* of the first folder element 22. The dimension of each folder element 22 and 23 measured parallel to the longitudinal axis of the wrapper 12, denoted D1 and D2 respectively, is at least equal to the corresponding axial dimension D3 of the end portion 14.

Figure 7:
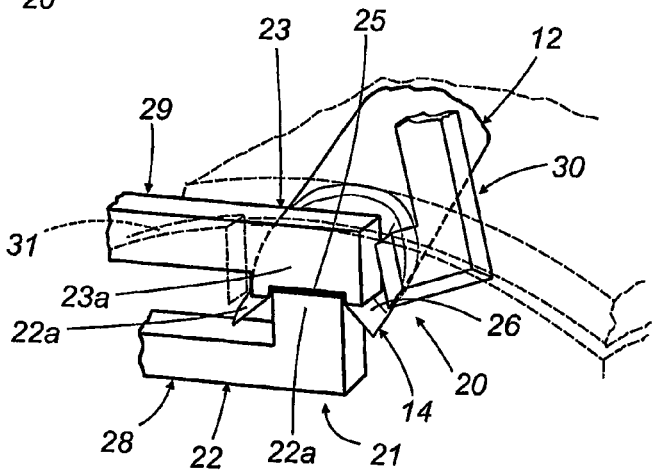
Figure 8:
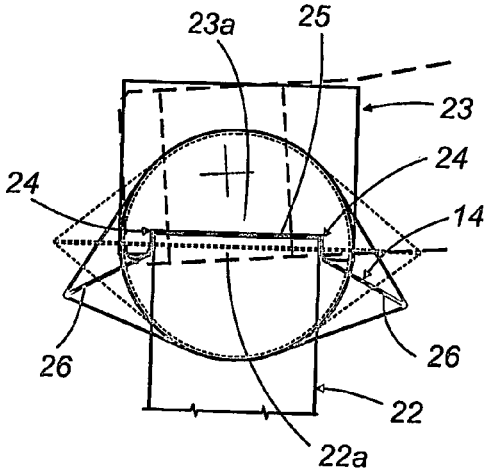
FIG. 8 is an elevation view showing the detail of FIG. 7.

More exactly, as illustrated in FIG. 7, the two crease lines 24 are impressed on the flattened end portion 14 by bending the two lateral portions 26 in relation to the central portion 25 along fold lines coinciding with the crease lines 24. The fold lines are established by the two internal corners 27*a* of the U-profiled recess 27.

The first folder element 22 and the second folder element 23 are afforded by respective arms 28 and 29 of which respective first ends 28*a* and 29*a* present the contact ends 22*a* and 23*a*, and respective second ends, not illustrated, are mounted pivotably so that the arms can rotate between the distanced position and the position of mutual proximity.

Figure 11:
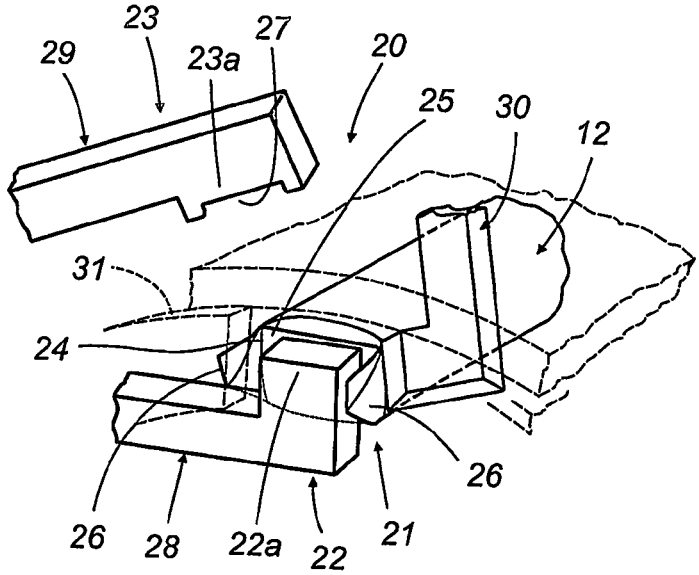
FIGS. 11 and 12 are perspective views illustrating a fifth detail of the device disclosed in respective subsidiary steps of a fifth operating step.

After the one arm 29 has been distanced from the other arm 28, the first folder element 22 rotates beyond the position occupied when in proximity to the second folder element 23, in such a way as to fold the central portion 25 against the corresponding end face of the group 1 (see FIG. 11).

As a result of crimping the end portion 14 to produce the crease lines 24, the step of folding the central portion 25 against the relative end face of the group 1 will cause the two lateral portions 26 to project axially from the group 1 and externally of the respective pocket 6.

Figure 12:
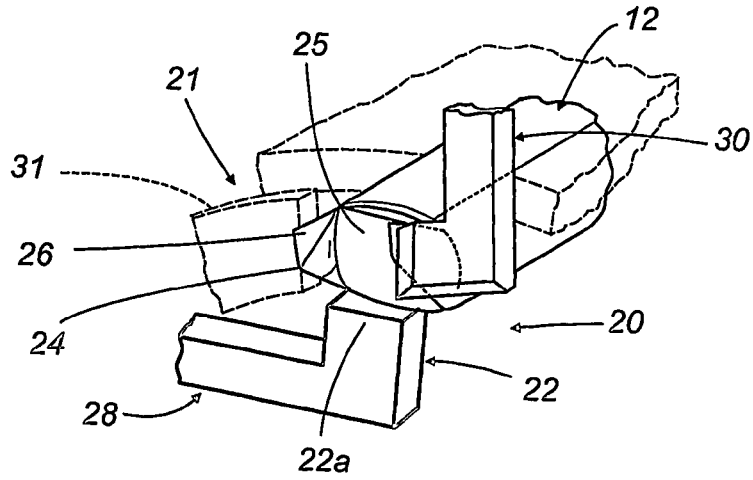

At this juncture, as discernible in FIG. 12, the lateral portion 26 positioned upstream relative to the direction of movement of the wrapping wheel 7 is folded over the central portion 25 by a third folder element 30 capable of movement in a direction perpendicular to the axis of the wheel 7, whereupon the remaining lateral portion 26 will be folded over the central portion 25 through the agency of a fixed folder element 31 by which it is intercepted as the wheel 7 continues to rotate.

The fixed folder element 31 is positioned to engage the second lateral portion 26 as the wrapping wheel 7 indexes through a further predetermined angle, again preferably 90°, to bring each stick pack 32, consisting in a group 1 of products 2 enveloped by a fully folded and sealed wrapper 12, into an outfeed station 33 where the packs 32 are ejected radially from the respective pockets 6 through the action of radial pusher means not illustrated in the drawings.

The invention affords important advantages.

First and foremost, the method according to the invention is instrumental in producing singularly compact and rigid packets by which the stacked products are firmly retained.

Moreover, the packets emerge faultlessly sealed at the two ends, so that neither air nor impurities can infiltrate.

The invention claimed is:

1. A method for wrapping groups of stacked products in the manufacture of sealed packs, comprising the steps of:

folding a sheet of heat-sealable wrapping material around a group of products;

sealing together two side edges of each sheet so as to fashion the sheet into a tubular wrapper having end faces, with end portions projecting axially from the group;

introducing a tongue into each tubular end portion in such a way as to spread and deform the end portion, causing it to assume a flattened appearance;

closing each flattened end portion by means of a heat-sealer to form closed end portions;

generating two crease lines on each closed end portion to divide each closed end portion into a central portion and two lateral portions, wherein the step of generating two crease lines on each closed end portion includes crimping each closed end portion between a first folder element and a second folder element presenting respective contact ends capable of movement between a position distanced one from the other and a position of proximity of one to another;

constructing and arranging the contact end of the first folder element to be of parallelepiped geometry and having a transverse dimension smaller than a transverse dimension of the closed end portion; constructing and arranging the contact end of the second folder element to present a "U-shaped" profile having a recess to accommodate the contact end of the first folder element;

folding the central portion against the respective end face of the group;

folding each of the two lateral portions over the central portion.

2. A method as in claim 1, wherein the step of generating two crease lines on the flattened end portion involves bending the two lateral portions relative to the central portion along lines coinciding with the crease lines.

3. A device for wrapping groups of stacked products in the manufacture of sealed packs, comprising:

feed means for positioning a sheet of wrapping material over a group of products;

pusher means for directing the group of products against the sheet and through a folding shoe such that the sheet is bent around the group to assume a "U-shaped" profile;

a wrapping wheel equipped with a plurality of conveying pockets to accommodate a group of products enveloped by the sheet with two side edges of the sheet projecting radially from the pocket, the wrapping wheel rotatable to direct each successive group of products through respective wrapping stations comprising a heat-sealer sealing two opposite side edges of the sheet, creating a tubular wrapper with end faces, with two end portions projecting externally of the pocket, a tongue by which the end portion is deformed and caused to assume a flattened appearance, heat-sealing means capable of movement toward and away from one another and sealing the flattened end portions, and a folding unit to fold the sealed end portions against the respective end faces of the group of products;

the folding unit comprising a first folder element and a second folder element presenting respective contact ends capable of movement between a position distanced one from the other and a position of mutual proximity in which the respective sealed end portion of the wrapper is crimped between the contact ends to generate crease lines dividing the end portion into a central portion and two lateral portions, the contact end of the first folder element being of parallelepiped geometry and having a transverse dimension smaller than a transverse dimension of the sealed end portion, the contact end of the second folder element having a "U-shaped" profile having a recess to accommodate the contact end of the first folder element.

4. A device as in claim 3, wherein the first folder element and the second folder element further comprise respective arms presenting respective first ends and being pivotable between a position distanced one from another and a position of proximity one to another.

5. A device as in claim 3, wherein the heat-sealing means comprise two heat seal elements presenting respective flat heated surfaces.

6. A device as in claim 3, wherein the first folder element folds the central portion of the end portion against the corresponding end face of the group.

7. A device as in claim 6, wherein the folding unit further comprises a third folder element capable of movement in a plane perpendicular to the axis of the wheel and serving to fold one of the lateral portions against the central portion.

8. A device as in claim 7, wherein the folding unit further comprises a fixed folder element by which the remaining lateral portion is engaged during the rotation of the wheel and folded against the central portion.

* * * * *